US005364588A

United States Patent [19]

Finkl et al.

[11] Patent Number: 5,364,588

[45] Date of Patent: Nov. 15, 1994

[54] DOUBLE STABILIZED STAINLESS-TYPE STEEL DIE BLOCK

[75] Inventors: Charles W. Finkl, Evanston; Guy A. Brada, Chicago; Algirdas A. Underys, Arlington Heights, all of Ill.

[73] Assignee: A. Finkl & Sons Co., Chicago, Ill.

[21] Appl. No.: 966,272

[22] Filed: Oct. 26, 1992

[51] Int. Cl.[5] ..... C22C 38/44

[52] U.S. Cl. ..... 420/67; 420/69

[58] Field of Search ..... 420/67, 69; 148/325

[56] References Cited

U.S. PATENT DOCUMENTS 3,595,643 6/1966 Boyce et al. ..... 420/67

4,180,420 12/1979 Sastri et al. ..... 420/67

*Primary Examiner*—Deborah Yee

*Attorney, Agent, or Firm*—Baker & McKenzie

[57] ABSTRACT

A 12 percent stainless-type steel having high polishability characterized by high carbon, moderate Mo and a combination of V and Nb not to exceed about 0.1 percent, and a method of production which includes forming a vacuum arc remelt electrode by means of vacuum arc degassing treatment and protective pouring.

4 Claims, 1 Drawing Sheet

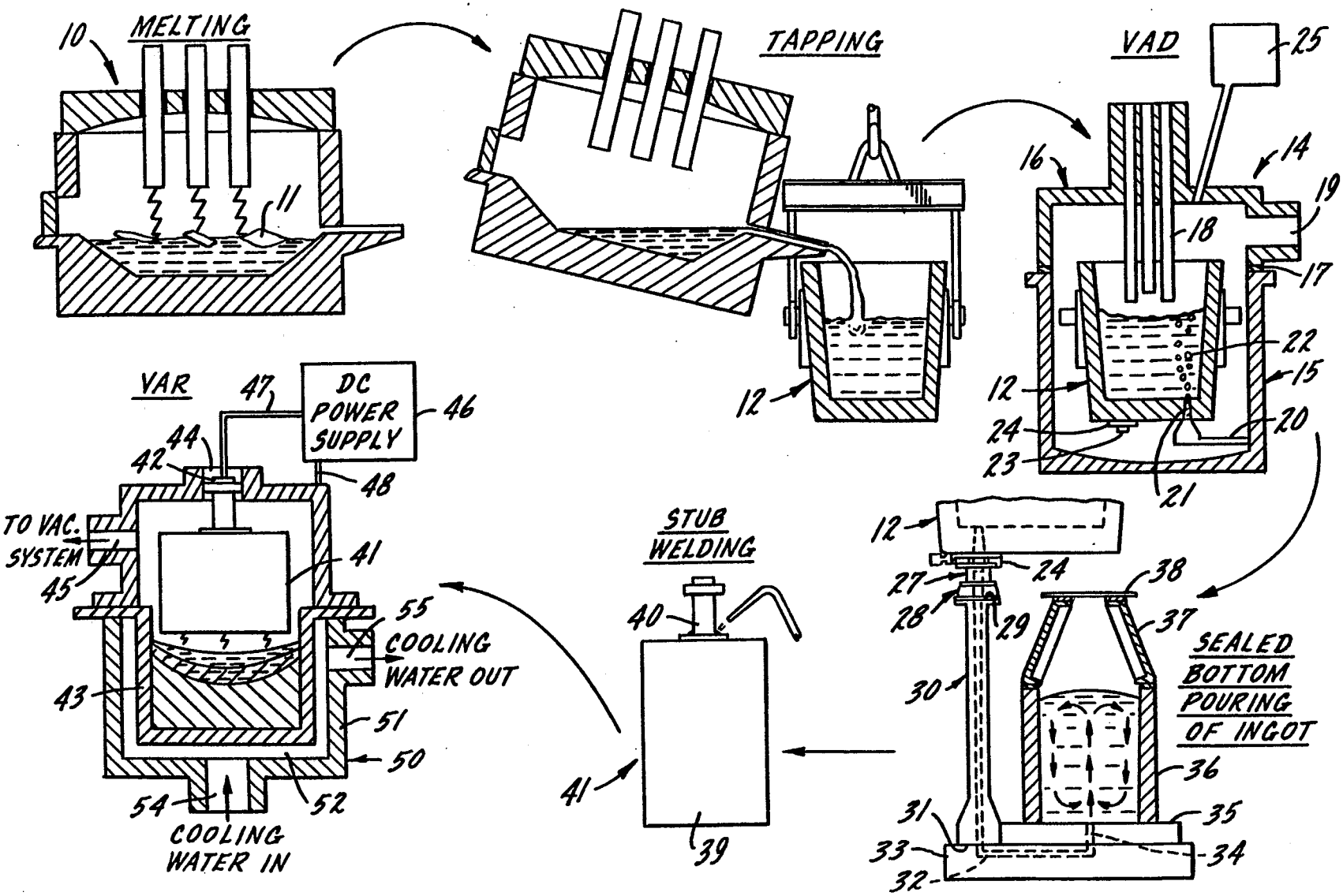
VAD
TAPPING
MELTING
SEALED BOTTOM POURING OF INGOT
STUB WELDING
VAR
DC POWER SUPPLY
COOLING WATER OUT
COOLING WATER IN
TO VAC. SYSTEM

DOUBLE STABILIZED STAINLESS-TYPE STEEL DIE BLOCK

This invention relates generally to a stainless-type steel and methods of production thereof, and specifically to a new stainless-type steel and a method of production thereof which results in lens quality steel.

BACKGROUND OF THE INVENTION

A need exists in many industries for a stainless steel which takes a high polish while having substantial mechanical properties including hardness, wear resistance and machinability. An exemplary application is so-called lens quality steel. The term lens quality means, as used in this application and with reference to the plastic forming industry, a steel which, when formed into a mold, is capable of taking, and retaining over a long period of use, a high polish. Examples of products produced by molds and dies made from such steel are clear plastic sheets which are used to form dashboard covers, or lens, in automobiles, the face shields which form the front portion of fighter pilot head masks, glass television picture tubes and medical industry equipment such as specimen holders and viewing plates. The criticality of these applications can be appreciated from the known requirements of their stated use; dashboard lens must provide true, undistorted instrument readings; fighter pilot head masks must not have any distorting defect at any location within the lines of sight of the user; televisions must provide undistorted viewing, and medical lens and specimen holders must not have flaws which an observer could confuse with the subject under study, such as cell growth, contour, absence or presence, i.e., an observer should not confuse a lens distortion for the presence of cancer cells. For purposes of ease of description and understanding, the term lens quality will be used in conjunction with steel for molds and dies used to produce automotive dashboard lenses.

At the current time several producers have attempted to supply Type 420 (UNS-S4200) stainless steel for molds to produce lens quality products, which steel has a specified composition of:

| C | Mn | P | S | Si | CR |
|---|---|---|---|---|---|
| Over .15 | 1.00 max | 0.040 max | 0.030 max | 1.00 max | 12.00 14.00 |

As noted in *Structures and Properties of Engineering Alloys,* William F. Smith, McGraw-Hill Inc., 1981, p. 285, the above steel and related steels such as 403, 410, 414, 422, 431, 440A, 440B and 440C is martinsitic. However, the chemical composition of such steels is limited since a minimum of 12 percent Cr is required for corrosion resistance. At this chromium level the maximum amount of carbon that can be added is about 0.15 percent or the excess carbon will precipitate carbides near the grain boundaries and lower the chromium content below the critical 12 percent level, thereby increasing the risk of corrosion. Further, the amount of alloying elements that can be added to martinsitic steel is limited since these elements, like carbon, tend to depress the $M_s$ transformation and, if the $M_s$ is depressed too low, austinite will be retained at room temperature. It has also been noted that the corrosion resistance of the martinsitic stainless steels is relatively poor compared to the austinitic and ferritic stainless steels. Most martinsitic stainless steels contain just the minimum 12 percent Cr required for passivity in moist air since, if more chrome was added, the formation of ferrite would be promoted at the expense of austinite, the latter being necessary for the formation of martinsite. The chemical composition of martinsitic stainless steels is designed for strength and hardness as well as corrosion resistance, and therefore the chemical balance for corrosion resistance in these alloys is poor.

As a consequence attempts have been made to use 420 stainless made by special processes, including electroslag remelting, and even double ESR techniques. The product produced by such a process is of course very expensive, and sales have been made at this writing at about $6 per pound. It has been discovered however that even this type of material has a high rate of rejection when used for molds which produce lens quality products such as TV screens and automotive dashboards. Such molds are polished to a very high degree and are required to take and hold such a polish for long production runs in a pressure die process.

Defects which can cause rejection are often attributable to the formation of chromium carbides in the steel which, in effect, underlies the mechanism of corrosion. Thus, it is desirable to keep Cr in solution at all times and in all phases of the steel. Should chromium carbides precipitate in the local areas at grain boundaries, the surrounding matrix is depleted of Cr and therefore, since the steel preferably is at or near its lowest Cr content to attain stainless characteristics, corrosion will occur in the Cr depleted areas or regions. This concept is often referred to as sensitization and for the conventional 12 percent Cr steel, corrosion inevitably follows if the carbon is about 0.3 percent since this amount of C will result in the formation of chromium carbides during the steel making process. It should also be noted that sensitization often occurs in welding, and can even occur during processing stages including solidification and/or heat treatment. It should also be noted in this connection that sensitization is used, not in the sense of denoting stainless characteristics, but rather in the sense of maintaining stainless characteristics more readily with a given Cr content.

Early attempts to reduce sensitization included forming steel with substantial contents of V and Nb and moderate amounts of Mo, or of large quantities Mo, but the resultant product did not produce a satisfactory steel. In the case of steel with substantial contents of V and Nb, metallographic examination disclosed the formation of very large V and Nb carbo nitrites [V, Nb (C, N)]. A steel with a high Mo was also investigated, but after apparently taking a good polish initially, it was found to be unsuitable.

Thus there exists a need for a stainless steel of lens quality, and, in addition, for such a steel which is more economical than the currently used steel in terms of a lower rejection rate, a lower cost per pound, or both, adequate hardness, good wear resistance, excellent through hardenability, good machinability, and excellent corrosion resistance.

SUMMARY OF THE INVENTION

This invention is a 12 percent stainless-type steel having a relatively high carbon content which takes a very high polish, is suitable for lens quality applications, and costs less than half the cost of current steels, together with a method of producing such a steel.

Specifically, the steel is characterized by containing carbon in the range of about 0.3–0.4, a moderate amount of Mo, and small, but effective, quantities of V or Nb, though, most preferably, a combination of V and Nb not to exceed 0.1 percent. Further, the steel is produced by a double vacuum process with the result that the final product has an exceedingly low sulphur and gas (H, N and O) content. Because of this low content, few sulfides, sulfide inclusions, sulfide stringers, oxide inclusions, or nitride precipitates are present that will affect polishability, together with exceedingly low H, N and O contents. As a consequence failure or imperfections resulting from too much H, N or O which function as stress raisers is precluded. The double vacuum process requires vacuum arc degassing of a melt to yield very low sulphur values on the order of those obtained by electroslag remelting, together with low gas values, followed by vacuum arc remelting to ensure exceedingly low final gas values while maintaining the low S content. The combination of low S together with low H, N and O in a 12% stainless type steel is not known today, even in conjunction with the use of ESR techniques.

BRIEF DESCRIPTION OF THE DRAWING

The process for producing the steel of this invention is illustrated more or less diagrammatically in the accompanying drawing which shows, in schematic form, the double vacuum process for producing very low S, H, N and O stainless steel capable of taking and retaining a very high polish during extended production runs.

DETAILED DESCRIPTION OF THE INVENTION

The invention is stainless-type steel having a relatively high carbon content which is capable of taking and maintaining a high polish during extended production runs and which, in its broadest formulation, has the following composition:

| | | | | | | | |
|---|---|---|---|---|---|---|---|
| carbon | from | about | .3 | to | about | .4 | |
| manganese | | | | | | 1.0 | max |
| phosphorous | | | | | " | .05 | max |
| sulphur | | | | | " | .010 | max |
| silicon | " | " | .2 | " | " | .6 | |
| nickel | | | | | " | .5 | max |
| chromium | " | " | 12 | " | " | 15 | |
| molybdenum | " | " | .35 | " | " | 1.10 | |
| aluminum | | | | | " | .030 | max |
| calcium | | | | | " | .004 | max |

together with vanadium in the virtual absence of niobium, to about 0.1 max, or niobium, in the virtual absence of vanadium, to about 0.1 max, or vanadium and niobium to about 0.1.

A more preferred formulation is as follows.

| | | | | | | | |
|---|---|---|---|---|---|---|---|
| carbon | from | about | .32 | to | about | .38 | |
| manganese | " | " | .30 | " | " | .55 | |
| phosphorous | | | | | " | .040 | max |
| sulphur | | | | | " | .006 | max |
| silicon | " | " | .20 | " | " | .50 | |
| nickel | | | | | " | .35 | max |
| chromium | " | " | 12 | " | " | 14 | |
| molybdenum | " | " | .35 | " | " | .65 | |
| aluminum | | | | | " | .020 | max |
| calcium | | | | | " | .003 | max |

together with vanadium, in the virtual absence of niobium, to about 0.08 max, or niobium, in the virtual absence of vanadium, to about 0.08 max, or vanadium and niobium to about 0.08 max.

Within the above-described formulation an aim composition is as follows:

| | | |
|---|---|---|
| C | .35 | |
| Mn | .40 | |
| P | .025 | max |
| S | .003 | max |
| Si | .40 | |
| Ni | .35 | max |
| Cr | 13.25 | |
| Mo | .45 | |
| V | .04 | |
| Nb | .04 | |
| Al | .020 | max |
| Ca | .003 | max |

It should be understood that Al and Ca are optional in that it is believed an acceptable steel can be made using less, or more, of these elements. The presence of these elements in the above formulation in this instance is attributable primarily to the processing of the heat prior to the first vacuum treatment; i.e.: air melting in an electric furnace by a double slag process, but it is believed that the desired results can be obtained by other methods which would not necessarily result in the presence Al or Ca in these, or any, amounts.

Likewise, certain other elements may be present optionally without adversely affecting the final product such as Cu which may be present up to a maximum of about 0.4 percent within the broad concept of the invention, or up to a maximum of about 0.35 percent in the more preferred formulation of the invention.

Preferably, Ti should not be present since titanium oxides can present problems during forging, but a small amount near a residual quantity may be tolerable.

Carbon is necessary to provide sufficient hardness and wear resistance to perform satisfactorily as a die in a die application. If less than about 0.3 C is present, the above requirements may not be met, or achieved only with difficulty. If more than about 0.4 C is present, grain boundary sensitization may be experienced and, also, transformation from a face centered austinite to a body centered martinsite may not be achieved to the degree required. Accordingly, carbon in the range of from about 0.32 to about 0.38 is preferred. The steel must, however, in all cases, have substantial carbide formers to give it wear resistance and hence a substantial quantity greater than the usual 0.15 carbon specified in type 420 is required.

Long experience has disclosed that about 0.30 Mn must be present to achieve the hardenability and strength required in die applications though it may, with careful processing, be possible to attain the desired characteristics with as little as 0.20 Mn. If much above 1.00 Mn is present, cleanliness problems are encountered in the steel making process. Accordingly, the most preferred range is from about 0.30 to about 0.55, since contents up to the latter figure can, with ordinary processing care, avoid such problems.

Phosphorous is useful to achieve polishability in the ultimate die surface. In addition, phosphorous, though not as effective as sulphur, contributes to machinability. Since in this steel sulphur is kept as low as possible, a substantial phosphorous content is permissible and hence up to a maximum of about 0.050 is feasible. If too much phosphorous is present, cleanliness problems can arise. Accordingly, is it preferred that phosphorous be present in a maximum amount of about 0.040 percent.

Since one of the most stringent requirements of this steel is polishability, and polishability is adversely affected by inclusions, many of which are attributable to the presence of sulphur, it is essential that sulphur be as low as possible. If strict processing controls are followed, including steps which tend to globularize the sulfide inclusions as contrasted to ordinary stringer type inclusions, as much as 0.010 sulphur may be tolerable. It is preferred, however, to limit sulphur to 0.006 maximum and, even more preferably, to a maximum of 0.003 percent. With such low sulphur contents it can be seen that machinability will be adversely affected and hence a substantial phosphorous content is desirable, as described above.

At least 0.20 silicon is essential for deoxidation during the steel making process and, also, silicon contributes to grain control. Although as much as 1.00 Si may, under carefully controlled conditions be tolerable, 0.6 percent or, more preferably, a maximum of about 0.5 is desirable. At the 0.6 and 0.5 levels hot shortness will not be encountered.

An alloying quantity of Ni is required for through hardening and to impart toughness to the steel, and up to about 0.35 Ni has been found to provide the desired effect. Ni, however, can adversely effect the martinsific transformation particularly in view of the fact that V and Nb are present. Accordingly, it is preferred that, although an alloying quantity of Ni be present to provide the requisite toughness, the Ni should be limited to a maximum 0.35 percent.

12% Cr is essential to cause the final product to be characterized as a potentially martinsitic stainless-type steel and hence at least this amount must be present at all times. On the other hand, too much Cr will preclude transformation of the austinite to martinsite and hence Cr should be present in an amount no greater than about 15 percent, and most preferably no more than about 14 percent.

Mo, in addition to contributing significantly to through hardening, has the unique property of requiring less free energy of carbide formation with an increase in temperature. Hence, at nearly all steel processing temperatures, and particularly at the upper end of the temperature range encountered in the steel making process, molybdenum carbides, which do not deplete the grain boundaries of Cr, are formed in preference to chromium carbides and hence a small but significant quantity of Mo is essential. At least about 0.35 Mo is necessary to achieve the desired preferential carbide formation described above. Acceptable, though not outstanding, results have been achieved with up to about 1.1 Mo. It is preferred, however, that a much lower quantity of Mo be used when V and Nb are present and hence the most preferable upper limit of Mo is about 0.55 percent. Mo is, in effect, a very important element in preventing sensitization at the high temperatures encountered during heat treatment, forging and solidification. In effect, the ultimate die user desires deep hardening dies with long life; i.e.: better wear resistance. All these attributes are provided when Mo is present in the specified amounts.

V and Nb are very important micro alloying additions which are mutually soluble and hence to a great extent interchangeable. These alloys have a higher affinity for carbon than Cr at all temperatures, and hence form carbides preferentially to the formation of chromium carbides. V in particular is not only a grain refiner and a stabilizer, but it is also a very potent hardener up to about 0.10 percent. These beneficial effects will be attained with respect to either element up to about 0.1 percent. Above about 0.1 percent, vanadium and niobium carbo nitrides [V, Nb (C, N)] grow too large and can become stress raisers and, also, adversely affect polishability. In effect, the steel may be described as dirty. Accordingly, it is preferred that when one is present in the absence of the other, the amount be a maximum of about 0.08 percent.

It should be noted that each of V and Nb acts to stabilize or, in effect, to de-sensitize the steel. Since each of these elements, in the very small micro-alloy quantities described herein, have been found to form carbides in preference to chromium at temperatures typical of this process, each of them stabilizes the steel in that their presence results in the Cr remaining within the grain and not migrating, or precipitating, at the grain boundaries as carbides which is a prelude to corrosion in the chrominum depleted regions.

Since these two elements are interchangeable to a great extent, it is also possible for the combined quantities, when both are present, to be a maximum of 0.1 percent, or, preferably, a maximum of 0.08 percent.

It is believed that a combination of the two elements is slightly more effective, for the same total amount, than either amount individually and hence it is preferred that both be present in alloying amounts up to a maximum of 0.1 percent in the broadest range or, more preferably, 0.08 percent.

Al is an excellent deoxidizer and up to about 0.030 percent max can be present. Al is of course an excellent grain refiner and in the end use, highly polished dies, a fine grain contributes to polishability. In the double vacuum process herein described the O content has been decreased very substantially as a result of vacuum arc degassing processing and hence a maximum of 0.020 Al may be quite sufficient in many instances.

Ca is very useful in the Al treatment of the melt as stated in the literature including U.S. Pat. Nos. 4,468,249 and 5,059,389, both assigned to the assignee of this application, and is preferably present in an amount of about 1/7 of the Al. Thus, when about 0.030 Al is present, Ca should be about 0.004 max, and when Al is present in an amount of about 0.020, Ca should be present in an amount of about 0.003 max.

Cu is, in effect, a tramp element. Some copper can be tolerated, but if much above about 0.4 percent is present there is a tendency toward embrittlement of the steel which adversely affects the properties required to the functioning of a lens quality die. Hence, Cu should be present, if at all, up to a maximum of no more than about 0.40 percent, or, more preferably, up to a maximum of about 0.3 percent.

Although titanium oxide has properties which might be considered useful in a die, the presence of titanium oxide can cause problems in forging the steel. Hence it is preferred that no Ti be present beyond a residual amount which does not adversely affect the desired properties of the steel.

An aim composition, having in mind the foregoing factors, is as follows:

| | |
|---|---|
| C | .35 |
| Mn | .40 |
| P | .025 |

-continued

| | | |
|---|---|---|
| S | .003 | |
| Si | .40 | |
| Ni | .35 | max |
| Cr | 13.25 | |
| Mo | .45 | |
| V | .04 | |
| Nb | .04 | |
| Cu | .35 | max |
| Al | .020 | max |
| Ca | .003 | max |

The heats of steel described hereinafter were melted in accordance with the invention in the double vacuum process illustrated in the FIGURE to be now described.

Referring now to the FIGURE, a conventional electric arc furnace is indicated generally at 10. As is well known, arc furnace 10 melts selected scrap, a few partially solid pieces of which are indicated at 11. Slag materials, such as lime, are added to the furnace along with make-up quantities of alloys and, also, oxygen. Preferably a two-slag treatment is used. The first slag is an oxidizing slag, one purpose of which is to decrease the oxygen and phosphorous levels. The bulk of the inclusions inherent in the furnace process are flushed out in this step. The first slag is then removed and a second, reducing slag, is added to the melt. The reducing slag removes oxygen from the heat thereby facilitating the prereduction of sulphur. Further alloy additions are made following one or more tests to bring the composition of the melt close to the final desired chemistry.

Following furnace treatment the molten steel, only, or the molten steel with only a small quantity of slag, is tapped into a VAD process ladle indicated at 12. Ladle 12 is then transported to the vacuum arc degassing station and lowered into the VAD processing tank or chamber indicated generally at 14. The VAD station is essentially a tank which may rest on the floor or be partially sunk into the floor. The tank includes a lower half, indicated generally at 15, and an upper half, indicated generally at 16. When the tank 14 is closed a seal 17 is formed between the two halves. Sealed electrodes are indicated at 18 and a connection to a vacuum system is indicated at 19. If, for example, a tank of approximately 1900 cubic feet is used to process a ladle containing on the order of about 65–70 tons of molten charge, a four-stage steam jet ejector system may be used which has the capacity to evacuate the closed chamber to pressures on the order of about 0.5 mm Hg absolute in about fifteen minutes. The electrodes may be graphite and of approximately 14 inches in diameter and suitably powered by an approximate 7.5 mega-Watt transformer.

A source of purging gas, such as argon or nitrogen, is indicated at 20, the gas being discharged through a porous plug 21 in the bottom of the ladle to emit a fine stream of gas which expands up to approximately 1400 times in volume as the individual gas bubbles 22 travel upwardly in the melt. The purging gas stirs the melt whereby portions of the melt remote from the surface are brought to the surface to equalize the temperature, to homogenize the melt whereby the chemical composition is made uniform throughout, and to form, within the individual bubbles of gas, low pressure zones into which the included deleterious gases, such as H, O, and N, can migrate as the bubbles travel upwardly and thereafter leave the system. A teeming nozzle 23 under control of a slide gate 24 is closed during this stage. An alloy hopper is indicated at 25, the hopper being used to fine tune selected alloy elements to achieve the final desired chemistry.

The violent slag interface reaction aids sulphur reduction. Sulphur can be removed to the level wherein successive heats can be consistently tapped at less than 0.003% S.

Calcium, silicon, aluminum and/or carbon wire may be added to achieve the optimum inclusion morphology and size distribution.

During VAD treatment the H may be lowered into the flake-free range of less than about 2.2 ppm, and, on occasion, to 1 ppm or even less. The O may be lowered from about 90 ppm to about 40 ppm, and the N may be lowered from about 220 ppm to about 100 ppm.

The melt is brought to the desired teeming temperature by regulation of the system variables including power input from electrodes 18, gas purge rate, and dwell time. As is now well known, the temperature of the melt can be consistently brought into the range of $\pm 10°$ F. of the desired teeming temperature using the VAD system.

Following VAD treatment the ladle 12 is moved to the bottom teeming or bottom pouring station. At the bottom pouring station a nozzle sleeve, indicated generally at 27, is secured to the slide gate 24 and thereafter the nozzle sleeve is brought into tight abutting engagement with a liner shroud, indicated generally at 28, located on the upper end 29 of a pouring trumpet indicated generally at 30. The bottom 31 of the pouring trumpet connects with a passage 32 in trumpet base 33, the passage communicating with a bottom port 34 in mould stool 35. Ingot mould 36 rests on mould stool 35 and a hot top is indicated at 37 and a mould seal plate at 38.

It will be understood that the molten metal path between the ladle 12 and ingot mould 37 is a closed passageway since a seal is formed between the nozzle sleeve 27 and the slide gate 24, between the nozzle sleeve and the pouring trumpet 30, between the pouring trumpet and trumpet base 33, and between mould stool 35 and ingot mould 36. The interior of the ingot mould 36 is a sealed chamber since there is a tight fit between the mould wall and the mould stool 35, between the mould and the hot top 37, and between the hot top and mould seal plate 38. The several seals are not as tight as the seals in the VAD unit but they are sufficiently tight fitting so that no ambient atmosphere can penetrate the system if there is a slight positive pressure in the system. In operation, a slight pressure is created in the system by the evolution of CO and, possibly to some extent, $CO_2$, as the metal flows into the pouring trumpet from ladle 12. The evolution will continue for substantially as long as the metal remains liquid. Since CO and $CO_2$ form a neutral atmosphere above the surface of the molten steel as it rises in the ingot mould, the molten metal is subjected to a protective neutral atmosphere at all, or substantially all, periods it is in a molten condition following pouring.

After suitable processing a stub 40 is welded to one end of the poured VAD ingot to complete the conversion of the VAD ingot into a VAR electrode.

The VAR electrode, indicated generally at 41, is then attached to the ram 42 of the VAR and inserted into the copper crucible 43 of the VAR.

The VAR includes crucible 43 which has a port 44 which receives ram 41 in vacuum tight relationship, and a vacuum off-take 45 which may for example be connected to an evacuation system which includes a mechanical vacuum pump and a Roots-type blower, the vacuum system having the capacity to evacuate the system to an operating pressure of on the order of about 10–20 mm Hg. Power is applied to electrode 41 by a DC power supply 46 connected to the stub 40 by conduit 47 and to the crucible by conduit 48.

A cooling jacket is indicated generally at 50, the jacket including an outer shell 51 which, together with the exterior of the crucible, forms a cooling chamber 52 surrounding that portion of the crucible which makes contact with molten steel. A cooling water inlet 54 and outlet 55 and suitable flow regulators, not shown, function to control the heat of solidification and, to some extent, control the rate of solidification of the final VAR ingot.

Following vacuum arc remelting the ingot was reheated to approximately 2250° F., and then forged to the desired shape and size with a minimum reduction of area of 5 to 1. After isothermal annealing the ingot was cycled up to a minimum of about 1850° F. in an annealing furnace and held for about one hour per inch of ruling dimension. Following annealing the ingot was then furnace cooled at the rate of about 40° F./hour until the steel temperature was below about 1100° F., and thereafter air cooled.

The following heats of steel were processed in accordance with vacuum arc degassing treatment and yielded the following post vacuum arc degassing chemistries:

| Heat | C | Mn | P | S | Si | Ni | Cr | Mo | V | Cu | Al | Nb | Ca |
|---|---|---|---|---|---|---|---|---|---|---|---|---|---|
| A | .35 | .43 | .017 | .003 | .47 | .20 | 13.47 | .63 | .070 | .10 | .024 | .0296 | .0014 |
| B | .35 | .44 | .024 | .002 | .35 | .34 | 13.69 | .50 | .065 | .09 | .010 | .031 | .0010 |
| C | .35 | .55 | .020 | .005 | .50 | .28 | 13.6 | .55 | .085 | .05 | .013 | .0290 | .0010 |
| D | .36 | .41 | .019 | .003 | .39 | .32 | 12.5 | .45 | .058 | .07 | .019 | .021 | .0013 |

The excellent through hardenability of this steel following heat treatment can be appreciated from the following Jominy tests.

| HEAT | | | | | |
|---|---|---|---|---|---|
| A | | C | | D | |
| J1 - 56 | J13 - 55 | J1 - 55 | J13 - 55 | J1 - 56 | J13 - 54 |
| J2 - 56 | J14 - 55 | J2 - 55 | J14 - 55 | J2 - 56 | J14 - 54 |
| J3 - 56 | J15 - 55 | J3 - 55 | J15 - 55 | J3 - 56 | J15 - 54 |
| J4 - 56 | J16 - 55 | J4 - 55 | J16 - 55 | J4 - 56 | J16 - 54 |
| J5 - 56 | J18 - 55 | J5 - 55 | J18 - 55 | J5 - 56 | J18 - 54 |
| J6 - 56 | J20 - 55 | J6 - 55 | J20 - 54 | J6 - 54 | J20 - 54 |
| J7 - 56 | J22 - 55 | J7 - 55 | J22 - 54 | J7 - 54 | J22 - 54 |
| J8 - 56 | J24 - 55 | J8 - 55 | J24 - 54 | J8 - 54 | J24 - 54 |
| J9 - 55 | J26 - 55 | J9 - 55 | J26 - 54 | J9 - 54 | J26 - 54 |
| J10 - 55 | J28 - 55 | J10 - 55 | J28 - 54 | J10 - 54 | J28 - 54 |
| J11 - 55 | J30 - 54 | J11 - 55 | J30 - 54 | J11 - 54 | J30 - 53 |
| J12 - 55 | J32 - 54 | J12 - 55 | J32 - 54 | J12 - 54 | J32 - 53 |

The excellent low S and low gas results of this invention can be appreciated from the following comparison of the four heats:

| | After Vacuum Arc Degassing | | | | After Vacuum Arc Remelt | | | |
|---|---|---|---|---|---|---|---|---|
| Heat | S | H | O | N | S | H | O | N |
| A | .003 | 2.6 | 34 | 158 | NA | NA | NA | NA |
| B-1 | .002 | 2.7 | 36 | 122 | .002 | .29 | 25 | 59 |
| B-2 | .002 | 2.7 | 36 | 122 | .002 | .31 | 31 | 60 |
| C | .005 | 1.0 | 41 | 138 | NA | NA | NA | NA |
| D | .003 | 1.7 | 20 | 136 | NA | NA | NA | NA |

NOTE: B-1 and B-2 are separate ingots.

From the foregoing it will be noted that a stainless-type steel having excellent polishability, through hardness, wear resistance and toughness, and a method of manufacture thereof, has been disclosed. It will be understood, however, that the scope of the invention should not be limited by the scope of the foregoing description. Rather, the spirit and scope of the invention should be limited only by the scope of the relevant prior art when interpreted in light of the following appended claims.

We claim:

1. A stainless-type steel die block having:

| | | | | | | |
|---|---|---|---|---|---|---|
| C | from | about | .3 | to | about | .4 |
| Mn | " | " | .3 | " | " | 1.0 |
| P | | | | | " | .05 max |
| S | | | | | " | .010 max |
| Si | " | " | .2 | " | " | .6 |
| Ni | | | | | " | .5 max |
| Cr | " | " | 12 | " | " | 15 |
| Mo | " | | .35 | " | " | 1.10 |
| Al | | | | | " | .030 max |
| Ca | | | | | " | .004 max |

together with V, in the virtual absence of Nb, to 0.1 max, or Nb in the virtual absence of V, to 0.1 max, or V and Nb combined to 0.1 max, Fe—balance.

2. The stainless-type steel die block of claim 1 having:

| | | | | | | |
|---|---|---|---|---|---|---|
| C | from | about | .32 | to | about | .38 |
| Mn | " | " | .30 | " | " | .55 |
| P | | | | | " | .040 max |
| S | | | | | " | .006 max |
| Si | " | " | .20 | " | " | .50 |
| Ni | | | | | " | .35 max |
| Cr | " | " | 12 | " | " | 14 |
| Mo | " | | .35 | " | " | .65 |
| Al | | | | | " | .020 max |
| Ca | | | | | " | .003 max |

together with V and Nb, singly or in combination, of 0.08 max, Fe—balance.

3. The stainless-type steel die block of claim 1 having the following approximate composition:

| | |
|---|---|
| C | .35 |
| Mn | .40 |
| P | .025 max |
| S | .003 max |
| Si | .40 |
| Ni | .35 max |
| Cr | 13.25 |
| Mo | .45 |
| V | .04 |
| Nb | .04 |
| Al | .020 max |
| Ca | .003 max |
| Fe | balance. |

4. A stainless-type steel die block having (a) the ability to take and hold a high polish during long production runs of lens quality products, (b) corrosion resistance, (c) excellent hardness, (d) good wear resistance, (e) good through hardenability, (f) machinability and, (g) substantial strength, said steel having:

| | | | | | | |
|---|---|---|---|---|---|---|
| C | from | about | .3 | to | about | .4 |
| Mn | | | | | " | 1.0 |
| P | | | | | " | .05 max |
| S | | | | | " | .010 max |

-continued

| | | | | | | |
|---|---|---|---|---|---|---|
| Si | " | " | .2 | " | " | .6 |
| Ni | | | | | " | .5 max |
| Cr | " | " | 12 | " | " | 15 |
| Mo | " | | .35 | " | " | 1.10 |
| Al | | | | | " | .030 max |
| Ca | | | | | " | .004 max |

together with V, in the virtual absence of Nb, to 0.1 max, or Nb in the virtual absence of V, to 0.1 max, or V and Nb combined to 0.1 max, Fe—balance.

* * * * *